United States Patent [19]

Derner et al.

[11] Patent Number: 4,829,729

[45] Date of Patent: May 16, 1989

[54] ANTI-EAVESDROPPING WINDOW STRUCTURE

[75] Inventors: Paul Derner; Peter Reichmann, both of Gelsenkirchen, Fed. Rep. of Germany

[73] Assignee: Flachglas Aktiengesellschaft, Furth, Fed. Rep. of Germany

[21] Appl. No.: 35,542

[22] Filed: Apr. 3, 1987

[30] Foreign Application Priority Data

Apr. 4, 1986 [DE] Fed. Rep. of Germany ..... 3611214

[51] Int. Cl.[4] ..... E04B 1/99; E06B 5/10

[52] U.S. Cl. ..... 52/171; 381/73.1; 381/191

[58] Field of Search ..... 52/171, 172; 381/73.1, 381/191

[56] References Cited

U.S. PATENT DOCUMENTS

| | | | |
|---|---|---|---|
| 4,019,295 | 4/1977 | Derner et al. | 52/172 |
| 4,047,351 | 9/1977 | Derner et al. | 52/172 |
| 4,052,564 | 10/1977 | Propst | 381/73.1 |
| 4,173,668 | 11/1979 | Hentzel | 52/171 |
| 4,319,088 | 3/1982 | Orfield | 381/73.1 |
| 4,352,039 | 9/1982 | Hagood | 381/191 |
| 4,610,115 | 9/1986 | Thompson | 52/171 |
| 4,686,693 | 8/1987 | Ritter | 381/73.1 |
| 4,687,687 | 8/1987 | Terneu | 52/171 |

FOREIGN PATENT DOCUMENTS 3417971 11/1985 Fed. Rep. of Germany .

*Primary Examiner*—John E. Murtagh
*Attorney, Agent, or Firm*—Herbert Dubno

[57] ABSTRACT

An anti-eavesdropping window structure in which the inner and outer panes, separated by a spacer frame have thickness d and D such that D/d is at least equal to 1.5. The space between the panes is filled with a gas mixture having a density in excess of that of air and a body-sound generator applied directly to the outer pane generates thermal noise over a frequency range of 200 to 3000 Hz to superimpose a level of such noise of at least 20 dB on transmitted sound.

10 Claims, 1 Drawing Sheet

ANTI-EAVESDROPPING WINDOW STRUCTURE

FIELD OF THE INVENTION

Our present invention relates to an anti-eavesdropping window structure and, more particularly, to a window structure which transmits light but yet prevents someone external of the enclosed space from listening in on whatever might transpire in the interior.

BACKGROUND OF THE INVENTION

It is known to provide an anti-eavesdropping window structure which comprises a plurality of glass panes including an outer pane and an inner pane separated from the outer pane by a spacer frame and which is filled with a gas and is provided with a sound generating unit to produce a sound which interferes with acoustic transmission through the window.

The assembly as thus described can be provided in a window frame and has been able, to a large measure, to prevent the pickup of speech and the like within the room provided that the window from the exterior utilizing directional microphones, vibration and acoustic pickup devices applied to outer parts of the window or to the outer pane, and even the most recently developed laser sensors which respond to vibration at the outer surface of the outer pane for eavesdropping purposes.

A disturbance-sound generator of the type which has been used in the prior art systems is here defined as a sound generator which is capable of delivering at a vibratile element, sound vibrations which are capable of setting the gas within the window structure in vibration and thus can transmit vibration to a structure to which this element is affixed or can radiate vibration into the gas-filled place.

Such disturbance-sound generators are usually electromagnetically energized by an electric current or with pulses and to this extent at least, the generator is an electroacoustic converter or transducer. The electromagnetic current or pulse train usually is generated in an electric-signal generator provided for this purpose and can be referred to as an interference-frequency generator.

A window structure of the aforedescribed type is described in German open application DE-OS No. 34 17 971, and, perhaps the best way of considering the system described in this open application is to consider points which will ultimately be found to distinguish it from the present invention.

Firstly, the structure itself is not treated as a sound-barrier structure and thus can be considered solely as an interference unit interposed between the sound to be protected and the potential eavesdropper. Indeed, the inner pane of this structure is a thick glass pane which is essentially the same thickness as an intermediate glass pane spaced therefrom by a relatively considerable distance toward the exterior and which are followed over a shorter spacing by a thin glass frame.

In the space between the two thick glass panes there is disposed an inclined glass pane which can, based upon its inclination, reflect sound waves. The compartments between the glass panes is filled with air and the interference-sound generator is a loudspeaker which generates the interference sound in the air filling of the interpane space.

There is no special indication as to what the frequency of the interference sound is and certainly there is nothing disclosed here as to any relationship of the structure to a sound attenuation effect with respect to transmitted sound.

With respect to general considerations, it is found that the described structure is expensive and for effective blockage of eavesdropping from the exterior, extremely high levels of interference sound must be generated in the window structure and this, of course, requires operation at very high energies.

The interference sound tends to pass into the room which is to be protected as well and creates a disturbance therein. There is no significant capability in this system to prevent laser-remote pickup from the outer surface of the window structure.

Thus, while using an interference-sound generator, the prior art window structure has been singularly unsuccessful in many respects to the point that its use has been avoided in many cases.

OBJECTS OF THE INVENTION

It is the principal object of the present invention to provide an improved anti-eavesdropping window structure which will overcome the drawbacks of the earlier system described above.

Another object of this invention is to provide a window which is capable of protecting the spoken word within a room from being eavesdropped upon from the exterior even with the use of sophisticated eavesdropping devices.

A further object of our invention i to provide an anti-eavesdropping window structure which can utilize relatively low levels of interference-sound generation and hence low powers, which can practically eliminate all transmission of sound from the interference-sound generator into the interior and which nevertheless practically eliminates any possibility of eavesdropping from the exterior.

SUMMARY OF THE INVENTION

These objects and others which will become apparent hereinafter are attained, in accordance with the invention in an anti-eavesdropping window structure comprising:

an outer transparent pane having a thickness d;

an inner transparent pane having a thickness D such that D/d is at least equal to 1.5;

a spacer frame engaging the peripheries of the panes and defining with the panes and between the panes a chamber;

a filling of a gas having a density greater than that of air in the chamber; and at least one body-sound generator of thermal noise in a frequency range of 200 to 3000 Hz and acting upon the outer pane, the panes, the frame and the filling having a sound-transmission attenuation of at least 40 dB as determined by German Industrial Standard DIN 52 210, and the body-sound generator being so energized that thermal noise emitted to the exterior from the outer pane is superimposed with an amplitude of at least 10 dB on sound transmitted through the window over all of the frequency range.

More specifically, the invention is characterized by the combination of the following features:

(a) The glass panes form a multipane acoustic insulation glass unit with an inner pane of a thickness D and an outer pane of a thickness d such that D/d is at least equal to 1.5.

(b) The gas filling between the panes is a gas which can be a pure gas or a gas/air mixture whose density is greater than that of air.

(c) The interference-sound generator is formed as a body-sound generator for thermal noise in the frequency range of 200 to 3000 Hz and acts directly upon the outer pane from within the window structure.

The term "body-sound generator" is used herein to describe a vibration generator whose output element is its outer housing structure and wherein that outer housing structure is applied to the inner surface of the outer pane.

According to the invention, the multipane insulating glass unit should have an estimated attenuation for transmitted sound in excess of 40 dB according to German Industrial Standard DIN 52 210 and the body-sound generator should be so energized that the sound produced by it and radiated outwardly from the outer pane over all of the above-mentioned frequency range of 200 to 3000 Hz should be superimposed to a level of at least 10 dB on transmitted sound.

The term "thermal noise" as used herein, will be understood to mean a mixture of statistically distributed sound frequencies of the type which arises in electronic amplifiers from unavoidable thermal electronic movement.

Such a mixture of frequencies is also known as white noise.

It will be appreciated that the sound generated by the white noise or interference generator should be superimposed at a level of at least 10 dB on sound transmitted from the interior to the exterior through the window structure.

The requirement that the body-sound generator should generate the thermal noise in the frequency range of 200 to 3000 Hz means only that for all frequencies in this range, there be thermal noise generation at a minimum of 10 dB superimposed upon the transmitted sound. The body-sound generator in this frequency range transforms the supplied electromagnetic oscillations or pulses into interference sound and applies the interference sound directly to the outer pane. It will be appreciated that the generator itself may be designed for this purpose and/or may be energized by a source of the appropriate frequencies.

The invention utilizes the fact that for every multipane acoustic insulation structure it is possible to determine comparatively simply a respective sound attenuation curve. This can be achieved by generating a sound of a particular frequency at the inner surface of the window structure and measuring the sound at the outer surface of the outer pane and calculating the loss in intensity. The attenuation curve is simply that series of values plotted on a graph of attenuation in decibels versus frequency. Indeed in many cases it is possible to simply determine the attenuation curves from literature values.

Once it is clear what the attenuation is and hence what the transmitted sound levels will be for frequencies in the range in interest, it is possible to energize the interference-sound generator, i.e. the body-sound generator, so that over the entire frequency range of interest it will superimpose at least 10 dB of interference sound on the transmitted sound in the form of white noise.

We have discovered, quite surprisingly, that as long as the superimposed sound generated by the body-sound generator exceeds 10 dB over the frequency range of 200 to 3000 Hz, the spoken word is no longer discernible from the exterior, no matter how sensitive and sophisticated the pickup used in attempted eavesdropping.

Because of the features (a)-(c) detailed above, moreover, there is practically no radiation of the interference sound inwardly from the inner pane.

Indeed, there is some vibration in the gas filling in the assembly but a transmission of such vibrations to the interior is practically excluded.

The vibrations generated in the window structure can be of such low energy that practically no inner transmission of the sound occurs.

While the window structure has been found to be effective for the frequency range of 200 to 300 Hz, it is possible to extend this range by correspondingly increasing the range over which the body-sound generator is effective.

While air can be used as the filling to lesser effect, it has been found that a gas filling with a density higher than that of air is important to optimum results.

According to a further feature of the invention, the inner pane is formed as a composite glass pane with the two glass sheets being bonded together with a vibration-damping bonding material such as a cast resin.

Advantageously, the two glass panes which have thicknesses of about 6 mm each and the cast resin layer can have a thickness of 1 mm or more for total thickness of the pane D which is equal to a greater thickness than 13 mm.

The outer pane can have a thickness of about 4 mm and the space between the panes a thickness of about 12 mm.

In the event the window structure may be subject to eavesdropping from outside utilizing a laser-remote sensor or the like, we can provide further means for preventing or interfering with such laser detection of the spoken word within the protected space.

According to the invention, therefore, the inner surface of the outer pane can be provided with a reflective coating, especially one which is effective in the infrared range, and which can be applied in any conventional way, i.e. by vapor deposition or the like.

Since such remote sensing generally utilizes lasers working in the infrared range, the coating results in a significant reduction of the ability utilizing such lasers to detect sounds emanating from the interior of the structure.

According to a further feature of the invention, the inner pane is coated on its inner side with an antireflection coating, preferably also by vapor deposition and advantageously also effective in the infrared range.

It is important to the present invention that the inner pane and the outer pane be decoupled from one another in the vibration-transmitting sense and consequently, the spacer frame can be a decoupling frame, i.e. a frame which has low stiffness and thus is intrinsically sound damping being composed, for example, of rubber.

When the assembly of the invention is introduced into a window frame, it is important that the frame itself not serve for the transmission of sound to the exterior so as to serve as a sound conduit by passing the anti-eavesdropping window structure.

In this case, the window frame itself may be provided with an auxiliary shell which decouples the window frame from the spacer frame and either the window frame or the shell or both can be provided with a further body-sound generator or a plurality of such body-sound generators which produce thermal noise and operate at least upon the shell. In this case as well, the above-mentioned rule should be observed and the sound amplitude of the generator should be such that the noise which is produced is superimposed on transmitted sound at a level of at least 10 dB over the entire range of 200 to 3000 Hz.

BRIEF DESCRIPTION OF THE DRAWINGS

The above and other objects, features and advantages of the present invention will become more readily apparent from the following description, reference being made to the accompanying drawing in which.

SPECIFIC DESCRIPTION

Figure 1:
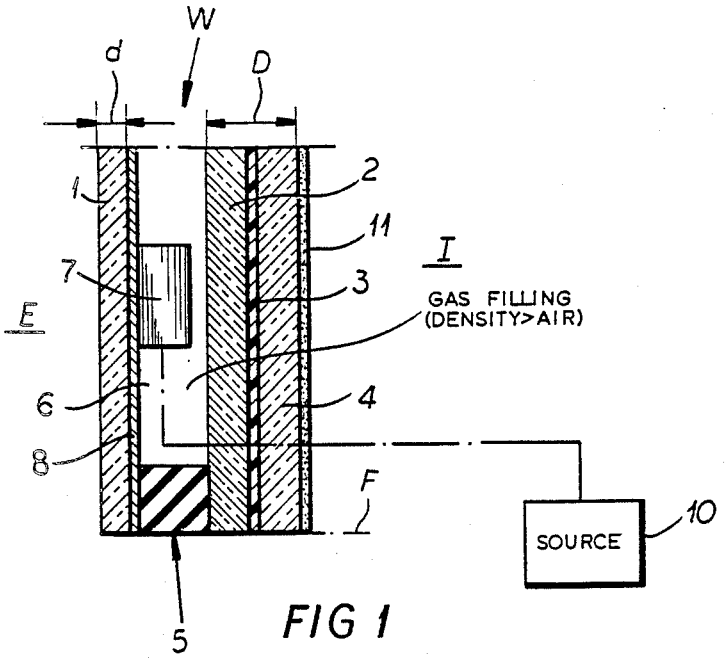
FIG. 1 is a cross-sectional view through the window structure of the invention.

The window structure W illustrated in FIG. 1 can be introduced into a window frame F to separate the exterior E at which eavesdropping may occur, from the interior I, namely, the space to be protected. The window structure W is particularly designed to prevent the spoken word within the interior from being detected by an eavesdropping device placed on or near the outer pane or utilizing laser sensing.

The window structure comprises an outer pane 1, an inner pane 2, 3, 4 and a spacer frame 5 between the outer pane and the inner pane so as to define between these panes a gas-filled interpane compartment 6.

In addition a body-sound generator 7, connected to an electrical source 10 is provided. A gas filling is provided in the compartment 6 although it is not visible in the drawing and hence has simply been labeled.

It should be immediately apparent that the panes 1 and 2–4 form a multipane insulating glass unit in which the inner pane 2, 3, 4 comprises a pair of glass sheets 2 and 4 bonded together by a bonding layer 3 so that the inner pane has a thickness D while the outer pane 1 has a thickness d such that D/d is greater than 1.5. In the embodiment shown and in a best-mode embodiment, D/d=3 or more.

The gas filling in the space 6 preferably consists of a gas/air mixture which is transparent and whose density is greater than that of air. A filling of sulfur hexafluoride and air is preferred in which the composition is 30% by volume sulfur hexafluoride and 70% by volume air.

The body-sound generator 7 is energized by the source 10 to produce thermal noise (white noise) over the frequency range of 200 to 3000 Hz and is applied directly to the outer pane 1 so that it primarily causes this pane to vibrate with the thermal noise while radiating little noise directly into interpane compartment 6.

The multipane insulating unit has a sound-transmission attenuation which can be estimated according to German Industrial Standard DIN 52 210. The body-sound generator 7 is so constructed that the thermal noise radiated outwardly from the outer pane 7 is superimposed o sound transmitted from the interior to the exterior through the window structure at a level of at least 10 dB over the entire range of 200 to 3000 Hz. In absolute terms this can be achieved by a very low level of energy supplied and utilized by the thermal-noise generator 7.

Figure 2:
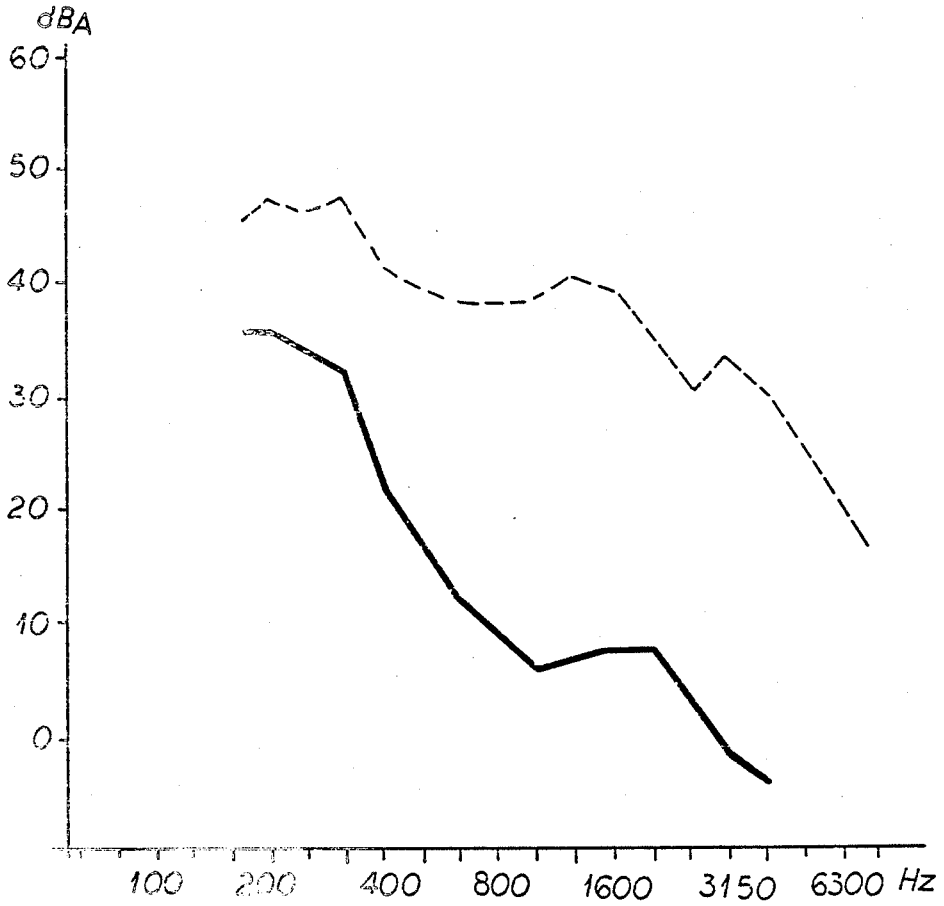
FIG. 2 is a graph illustrating principles of the invention.

These conditions should be clear from FIG. 2 in which the frequency has been plotted along the abscissa and the transmitted sound level $dB_A$ along the ordinate. $dB_A$ is the sound level detectable at the exterior based upon the evaluation of the attenuation of the window structure in the manner described. The broken-line curve represents the sound level at the exterior resulting from the superimposition of the thermal noise on the transmitted sound, the superimposition itself being represented by the difference between the sound transmitted through the window (solid line curve) and the total sound detected at the exterior (broken-line curve). The interference sound level can be seen to be in excess of 10 dB above the level represented by the solid line curve over the entire range of frequencies.

In practice, the two glass sheets 2 and 4 can each have a thickness of about 6 mm and the cast resin layer 3, which can be of a type used in the production of safety glass, can have a thickness of 1 to 1.2 mm.

The outer pane can have a thickness of about 4 mm and the space between the panes can have a thickness of 12 mm.

The outer pane 1 is provided on its inner surface with a reflective coating 8 which can be especially effective in the infrared range and thus reduces the ability to use laser eavesdropping techniques.

The inner surface of the inner pane can be provided with an antireflection coating which has been represented at 11. The reflective coating can be vapor deposited and is especially effective in the infrared range.

The spacer frame is composed of a material, e.g. rubber, with low stiffness so that it can decouple the panes from one another in a vibration-transmitting sense.

The window structure W, can, as noted, be provided in the frame F and to decouple the frame from the window in a vibration-transmitting sense, an auxiliary shell can be provided and can extend inwardly from the frame of the window. Either the window frame or the shell may be provided with a body-sound generator which is coupled directly to it and produces thermal noise in the range of 200 to 3000 Hz at a level to superimpose at least 10 dB of such thermal noise on transmitted sound in the manner described.

We claim:

1. An anti-eavesdropping window structure comprising:

an outer transparent pane having a thickness d;

an inner transparent pane having a thickness D such that D/d is at least equal to 1.5, said inner transparent pane being a composite pane having two glass sheets sandwiching a vibration damping glass-sheet-bonding layer between them;

a spacer frame engaging the peripheries of said panes and defining with said panes and between said panes a chamber;

a filling of a sound-damping gas having a density greater than that of air in said chamber; and at least one body-sound generator of thermal noise in a frequency range of 200 to 3000 Hz acting through the inside of said chamber solely upon said outer pane, said panes, said frame and said filling having a sound-transmission attenuation of at least 40 dB, and said body-sound generator being so energized that thermal noise emitted to the exterior from said outer pane is superimposed with an amplitude of at least 10 dB on sound transmitted through said window over all of said frequency range, said panes and said gas limiting penetration of sound generated by said generator into a space bounded by said window.

2. The anti-eavesdropping window structure defined in claim 1 wherein said sheet-bonding layer is a transparent cast resin.

3. The anti-eavesdropping window structure defined in claim 2 wherein said sheets each have a thickness of about 6mm and said layer has a thickness of at least 1 mm.

4. The anti-eavesdropping window structure defined in claim 3 wherein said outer pane has a thickness of about 4 mm.

5. The anti-eavesdropping window structure defined in claim 4 wherein said panes are spaced apart by a distance of about 12 mm.

6. The anti-eavesdropping window structure defined in claim 1 wherein said outer pane is provided on an inner surface thereof with a reflective coating.

7. The anti-eavesdropping window structure defined in claim 6 wherein said antireflection coating is effective in an infrared range.

8. The anti-eavesdropping window structure defined in claim 1 wherein said inner pane is provided on an inner surface thereof with an antireflection coating.

9. The anti-eavesdropping window structure defined in claim 8 wherein said antireflection coating is effective in an infrared range.

10. The anti-eavesdropping window structure defined in claim 1 wherein said frame is composed of a material decoupling said panes from one another with respect to vibration transmission.

* * * * *